US008801053B2

(12) United States Patent
Alexander et al.

(10) Patent No.: US 8,801,053 B2
(45) Date of Patent: Aug. 12, 2014

(54) CLOSURE LATCH AND RELEASE MECHANISM

(75) Inventors: Paul W. Alexander, Ypsilanti, MI (US); Joseph P. Fannon, Washington, MI (US); Bobbi E. Alton, Royal Oak, MI (US); James Holbrook Brown, Temecula, CA (US); Brian W. Bowling, Ladera Ranch, CA (US); Alan L. Browne, Grosse Pointe, MI (US)

(73) Assignees: GM Global Technology Operations LLC, Detroit, MI (US); Dynalloy, Inc., Costa Mesa, CA (US)

( * ) Notice: Subject to any disclaimer, the term of this patent is extended or adjusted under 35 U.S.C. 154(b) by 270 days.

(21) Appl. No.: 13/249,698

(22) Filed: Sep. 30, 2011

(65) Prior Publication Data

US 2012/0126551 A1 May 24, 2012

Related U.S. Application Data

(60) Provisional application No. 61/416,058, filed on Nov. 22, 2010.

(51) Int. Cl.
*E05C 3/16* (2006.01)

(52) U.S. Cl.
USPC ..... 292/226

(58) Field of Classification Search
CPC ..... E05B 47/0002; E05B 85/243
USPC ..... 292/201, 216, DIG. 23
See application file for complete search history.

(56) References Cited

U.S. PATENT DOCUMENTS

| | | | | |
|---|---|---|---|---|
| 3,386,761 | A * | 6/1968 | Johnstone et al. | 292/201 |
| 4,478,441 | A * | 10/1984 | Fiordellisi et al. | 292/216 |
| 4,783,102 | A * | 11/1988 | Bernard | 292/216 |
| 6,112,564 | A * | 9/2000 | Rathmann et al. | 70/279.1 |
| 6,116,664 | A * | 9/2000 | Wegner | 292/216 |
| 2002/0074806 | A1 * | 6/2002 | Perkins et al. | 292/14 |
| 2007/0056338 | A1 * | 3/2007 | Sabo et al. | 70/257 |
| 2009/0230700 | A1 * | 9/2009 | Arabia et al. | 292/93 |
| 2009/0250952 | A1 * | 10/2009 | Niskanen et al. | 292/341.15 |
| 2010/0052336 | A1 * | 3/2010 | Bendel et al. | 292/196 |

FOREIGN PATENT DOCUMENTS

WO WO 2007140606 A1 * 12/2007 ..... E05B 47/00

* cited by examiner

*Primary Examiner* — Kristina Fulton
*Assistant Examiner* — Nathan Cumar
(74) *Attorney, Agent, or Firm* — Quinn Law Group, PLLC

(57) ABSTRACT

A latch assembly includes a forkbolt movable between a released position, allowing opening of a closure, and a restrained position, preventing opening of the closure. A forkbolt spring is configured to bias the forkbolt toward the released position. A primary detent is mounted with respect to the forkbolt and movable between an open position, allowing the forkbolt to move into the released position, and a closed position, not allowing the forkbolt to move into the released position. A secondary detent is movable between an unlocked position, allowing the primary detent to move into the open position, and a locked position, preventing the primary detent from moving into the open position. An actuator selectively moves the secondary detent from the locked position to the unlocked position.

16 Claims, 4 Drawing Sheets

CLOSURE LATCH AND RELEASE MECHANISM

CROSS-REFERENCE TO RELATED APPLICATIONS

This application claims the benefit of U.S. Provisional Application No. 61/416,058, filed Nov. 22, 2010, which is hereby incorporated by reference in its entirety.

TECHNICAL FIELD

This disclosure relates generally to latch assemblies or mechanisms for performing such functions as release and capture of vehicle closures.

BACKGROUND OF THE INVENTION

Vehicle hood, side door, or closure (release and retention) systems may include an electrically-driven mechanism, a hand lever, or a pull handle attached to a cable, which is cooperatively used to release the latching mechanism of the closure. Mechanical release mechanisms may require a physical action on the part of the vehicle operator, e.g., pulling of a handle or lever. Many release mechanisms act directly upon the detent of a latch to release the forkbolt of the latch, which allows the closure to be released.

SUMMARY

A latch assembly for a vehicle having one or more closures is provided. The latch assembly includes a forkbolt movable between a released position and a restrained position. The released position allows opening of the closure, and the restrained position prevents opening of the closure. A forkbolt spring is operatively attached to the forkbolt and is configured to bias the forkbolt toward the released position.

A primary detent is mounted with respect to the forkbolt and is movable between an open position and a closed position. The open position of the primary detent allows the forkbolt to move into the released position, but the closed position of the primary detent does not allow the forkbolt to move into the released position.

A secondary detent is mounted with respect to the primary detent and is movable between an unlocked and a locked position. The unlocked position of the secondary detent allows the primary detent to move into the open position, but the locked position of the secondary detent will not allow the primary detent to move into the open position.

A tension spring is operatively attached to the secondary detent and is configured to bias the secondary detent toward the locked position. An actuator is configured to selectively move the secondary detent from the locked position to the unlocked position in the presence of an activation signal. Furthermore, the actuator may act on a tension lever.

The above features and advantages and other features and advantages of the present invention are readily apparent from the following detailed description of the best modes and other embodiments for carrying out the invention when taken in connection with the accompanying drawings.

DESCRIPTION OF PREFERRED EMBODIMENTS

Figure 1:
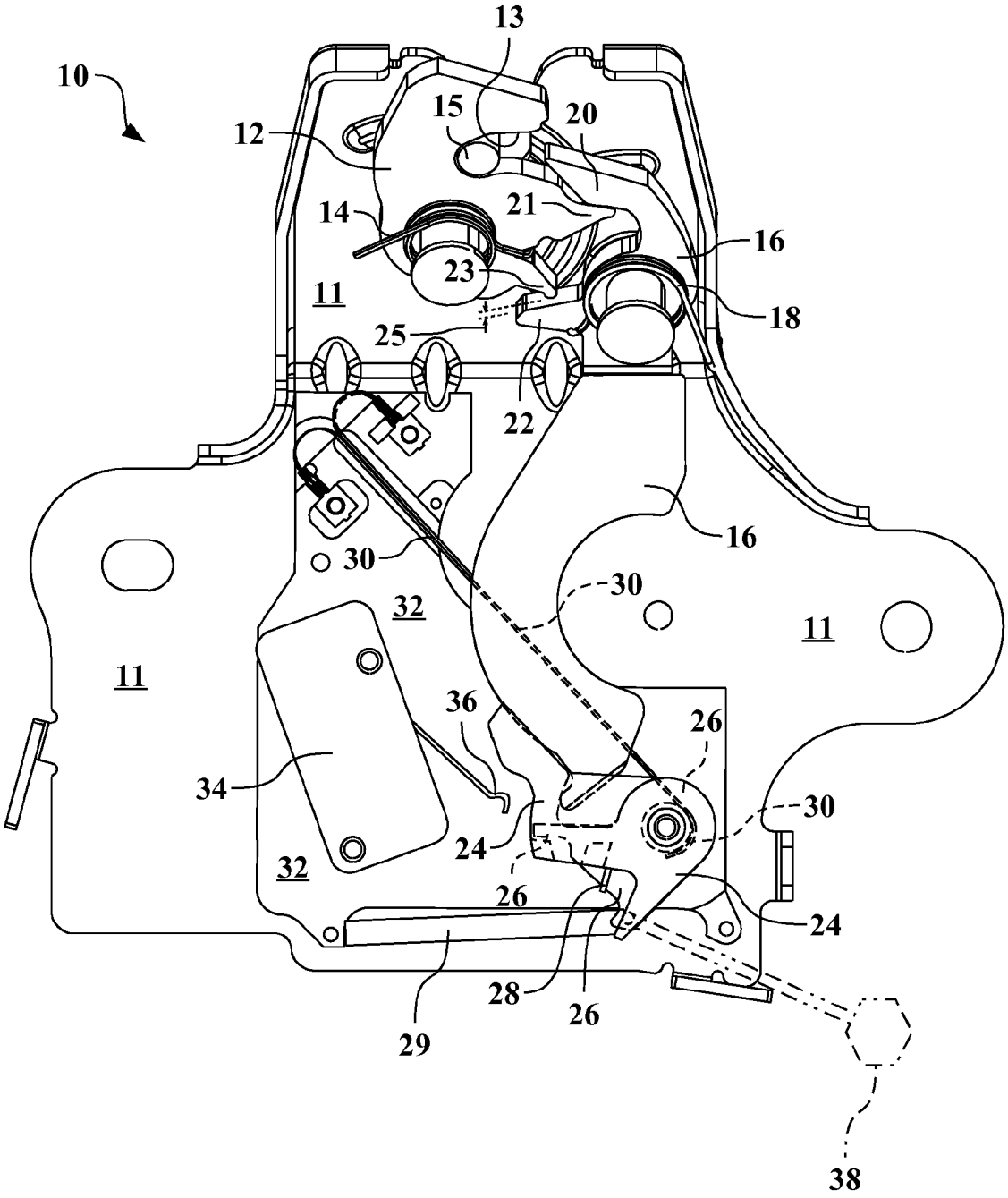
FIG. 1 is a schematic plan view of a latch assembly usable as a closure latch and release, shown in a locked position configured to restrain the closure tightly to the vehicle.
Figure 2:
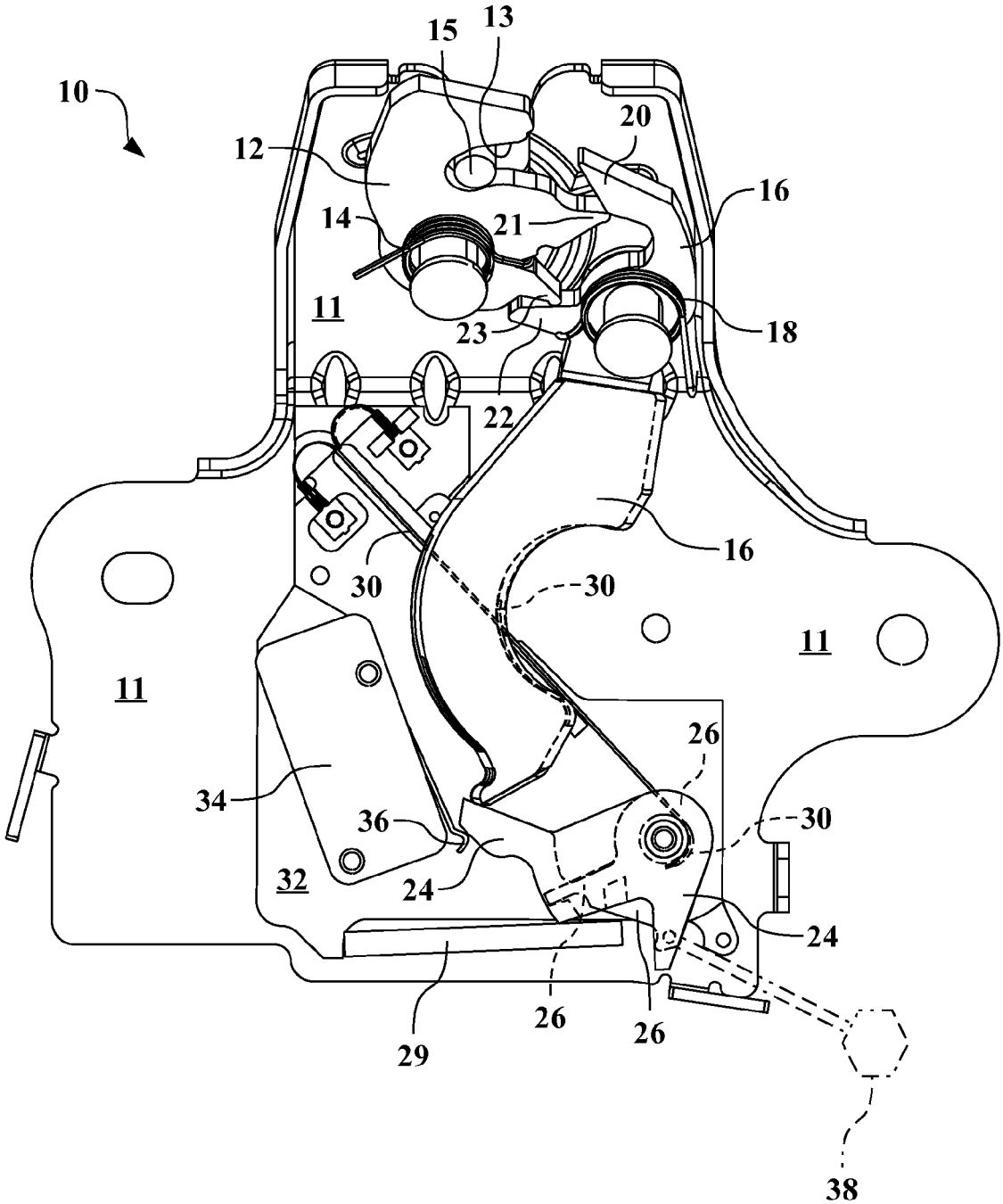
FIG. 2 is a schematic plan view of the latch assembly shown in FIG. 1, showing the latch assembly in an unlocked and ready-to-release position.
Figure 3:
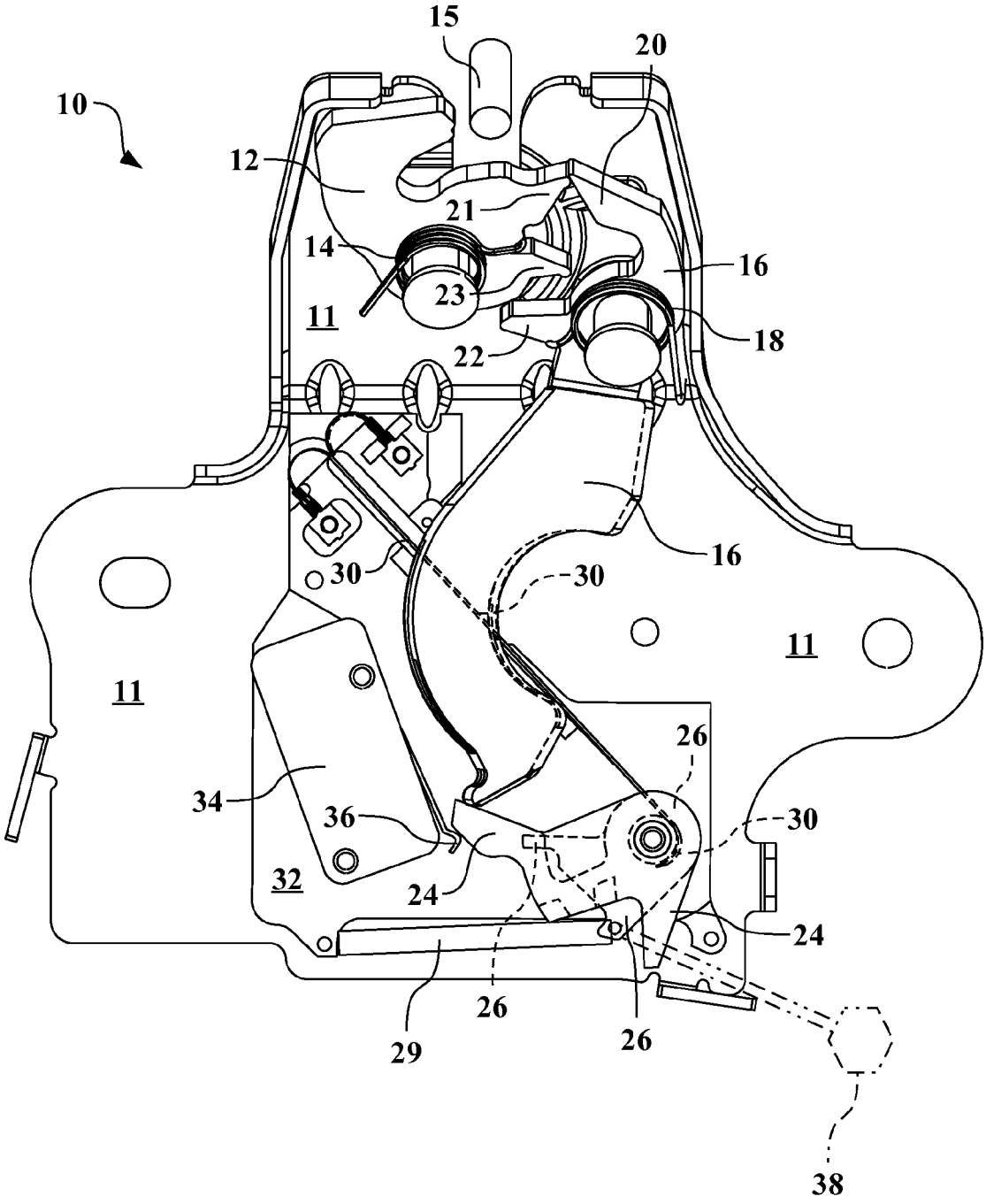
FIG. 3 is a schematic plan view of the latch assembly shown in FIGS. 1 and 2, showing the latch assembly in a fully-released position, which allows the closure to be pulled away from the latch assembly.

Referring to the drawings, wherein like reference numbers correspond to like or similar components throughout the several figures, there is shown in FIGS. 1-3 a latch assembly 10 for a vehicle (not shown). The latch assembly 10 may be used as a closure latch configured to selectively hold and release (as described herein) a closure. As used herein, closure may refer to: a closure, hood, cowling, bonnet, or trunk; a liftgate or hatch door; or any other closure of the vehicle, as would be recognized by a person having ordinary skill in the art. The latch assembly 10 may be used as a primary closure latch and coupled with a manual secondary latch mechanism, such that both latches need to be released before the hood can be fully opened or lifted away from the vehicle. As shown in FIGS. 1-3, a portion of the latch assembly 10 may be bent to accommodate vehicle architecture, such that the latch assembly 10 is on two planes and the upper portion (as viewed in the figures) is angled toward the viewer.

FIG. 1 shows the latch assembly 10 in a completely restrained position which completely prevents or restrains the vehicle closure from opening. FIG. 2 shows the latch assembly 10 in a mid-release position, in which the closure is loose but has not yet been released. FIG. 3 shows the latch assembly 10 in a released or open position, in which the closure is free to be raised away (typically upward) from the vehicle, possibly subject to release of the manual secondary latch. Those having ordinary skill in the art will recognize that the individual elements of the schematic drawings may not be to scale relative to each other, and the drawings may not be to scale relative to each other.

A forkbolt 12 has a slot or gate 13 which is configured to restrain movement of a striker bar 15 which is rigidly attached to the closure. The striker bar 15 is shown only partially in the figures, and the size and location thereof is illustrative only. The forkbolt 12 is movable between a released position and a restrained position. The restrained position is shown in FIG. 1 and represents complete restraint of the striker bar 15, such that the closure is securely pulled to the vehicle and cannot be opened. The released position of forkbolt 12 may be considered to encompass all positions, rotations, or movements beyond the restrained position.

The released position of the forkbolt 12 allows release of the striker bar 15. However, actual release of the striker bar 15 and opening of the closure may require actuation of another, manual closure latch (not shown), as with a hood latch, and may require an outside force from the vehicle operator. FIGS. 2 and 3 show the forkbolt 12 in the released position, such that the striker bar 15 is either moveable within the gate 13 (as shown in FIG. 2,) and therefore allows some movement of the hood relative to the vehicle, or is free to be removed from the gate (upward, as shown in FIG. 3).

A forkbolt spring 14 may be operatively attached to the forkbolt 12 and to a housing 11 which is rigidly attached or affixed to the vehicle. Forkbolt spring 14 is configured to bias the forkbolt 12 toward the released position (a counterclockwise bias, as shown in FIGS. 1-3). In the latch assembly 10 shown in FIGS. 1-3, forkbolt spring 14 is a torsion spring. However, a linear-type (compression or tension) spring or another component configured to bias the forkbolt 12 may also be used.

A primary detent 16 is mounted with respect to the forkbolt 12 and movable between an open position and a closed position. The closed position of the primary detent 16 is shown in FIG. 1 and the open position is shown in FIGS. 2 and 3.

The latch assembly 10 may include a primary detent spring 18 operatively attached to the primary detent 16 and to the housing 11. The primary detent spring 18 is configured to bias the primary detent 16 toward the open position (clockwise, as shown in FIGS. 1-3). In FIGS. 1-3, the primary detent spring 18 is a torsion spring. A linear-type (compression or tension) spring or another component configured to bias the primary detent 16 may also be used. Other bias directions for the primary detent 16 may also be used.

The primary detent 16 interfaces with the forkbolt 12 to limit relative movement between the forkbolt 12 and the primary detent 16. The open position of the primary detent 16 allows movement of the forkbolt 12 into the released position, and the closed position of the primary detent 16 prevents movement of the forkbolt 12 into the released position.

The primary detent 16 includes a first bite tooth 20 and the forkbolt 12 includes a second bite tooth 21. The first bite tooth 20 and the second bite tooth 21 cooperate to prevent movement of the forkbolt 12 into the released position unless the primary detent 16 is in the open position. When the primary detent 16 rotates far enough in the clockwise direction (as viewed in FIG. 1-3), the first bite tooth 20 will clear the second bite tooth 21 and allow the forkbolt 12 to rotate counterclockwise (as viewed in FIG. 1-3), freeing the striker bar 15.

The primary detent 16 also includes a first cam tooth 22 and the forkbolt 12 includes a second cam tooth 23. A cam tooth clearance 25 between the first cam tooth 22 and the second cam tooth 23 allows some movement of the primary detent 16 toward the open position while the forkbolt 12 is still in the restrained position. The movement of the primary detent 16 toward the open position is provided by the bias of the primary detent spring 18 toward the open position.

Therefore, if the forkbolt 12 is prevented from moving into the released position because (for example and without limitation) there is a load preventing the closure from opening, the primary detent 16 will still move out through the cam tooth clearance 25 of the closed position and the latch assembly 10 will not re-latch itself. The size of the cam tooth clearance 25 between the first bite tooth 20 and the second bite tooth 21 may be tuned to control the amount of movement of the primary detent 16 toward the open position while the forkbolt 12 is still in the restrained or semi-restrained position.

A secondary detent 24 is mounted with respect to the primary detent 16 and movable between an unlocked and a locked position. The secondary detent 24 interfaces with the primary detent 16 to limit movement of the primary detent 16 relative to both the secondary detent 24 and the forkbolt 12. The actual interface regions of the primary detent 16 and the secondary detent 24 are hidden from view in FIG. 1 by a nearer portion of the secondary detent 24. Portions of the secondary detent 24 and the primary detent 16 hidden from view are shown with phantom lines.

The locked position of the secondary detent 24 is shown in FIG. 1 and the unlocked position is shown in FIGS. 2 and 3. The unlocked position of the secondary detent 24 allows the primary detent 16 to move into its open position, and the locked position of the secondary detent 24 will not allow the primary detent 16 to move into its open position. Furthermore, when the primary detent 16 is in the open position and has closed the cam tooth clearance 25, the secondary detent 24 is prevented from returning to the locked position, even if the forkbolt 12 is not able to open to the released position, as shown in FIG. 2.

A tension lever 26 is generally coaxial with the secondary detent 24. Much of the tension lever 26 is located behind the secondary detent 24 in the figures, and the hidden portions are shown with phantom lines. The tension lever 26 is configured to rotate the secondary detent 24 from the locked to the unlocked position (clockwise, as viewed in FIGS. 1-3). However, the tension lever 26 is not configured to rotate the secondary detent 24 back from the unlocked to the locked position. The tension lever 26 may be considered as selectively engaging the secondary detent 24 (as shown in FIGS. 1 and 2) and selectively moving without the secondary detent 24 (as shown in FIG. 3).

Therefore, clockwise rotation of the tension lever 26, when engaged with the secondary detent 24, will cause the secondary detent 24 to move to its unlocked position, which allows the primary detent 16—under the bias force of the primary detent spring 18—to open. When the tension lever 26 is rotated counterclockwise back to its starting position, the tension lever 26 may become disengaged such that the secondary detent 24 is free to remain in its unlocked position and the primary detent 16 is free to stay in its open position.

A tension spring 28 is operatively attached to the secondary detent 24 and the tension lever 26. The tension spring 28 is disposed between the secondary detent 24 and the tension lever 26 and is only partially viewable in FIGS. 1-3. The tension spring 28 is configured to bias the secondary detent 24 toward the locked position (clockwise, as shown in FIGS. 1-3). In the latch assembly 10 shown in FIGS. 1-3, tension spring 28 is a torsion spring. However, any type of spring may also be used.

The tension spring 28 may also be configured to bias the tension lever 26 in the counterclockwise direction relative to the secondary detent 24. Alternatively stated, the tension spring 28 is configured to bias the secondary detent 24 and the tension lever 26 to rotate in opposing directions.

A return spring 29 biases the tension lever 26 away from engagement with the secondary detent 24 (in the clockwise direction, as viewed in FIGS. 1-3) and toward the starting position (which is shown in FIGS. 1 and 3). The return spring 29 shown is a linear spring, but may also be any type of spring. Therefore, the return spring 29 pulls the tension lever 26 away from the secondary detent 24 if the primary detent 16 is in the open position and blocking the ability of the secondary detent 24 to return to the locked position.

In other configurations of the latch assembly 10, the tension spring 28 may act solely between the secondary detent 24 and the housing 11. Therefore, the tension spring 28 may simply bias the secondary detent 24 toward the locked position. In such a configuration, the return spring 29 may still bias the tension lever 26 back to its starting position.

Operation of latch assembly 10 is effected by an actuator 30, which is operatively connected to the tension lever 26 and to either the housing 11 or an actuator base 32. In the presence of an activation signal, the actuator 30 is configured to selectively move the tension lever 26 into engagement with the secondary detent 24 (counterclockwise, as viewed in the figures) and, therefore, to move the secondary detent 24 from the locked position to the unlocked position.

The actuator 30 may be configured with on/off or engaged/disengaged settings. Once the actuator 30 is no longer engaged, the return spring 29 will be able to return the tension lever 26 back to its starting position.

The actuator 30 shown in FIGS. 1-3 is a linear actuator, and may be an active material based actuator. For example the actuator 30 may be a shape memory alloy (SMA) wire. However, the actuator 30 may also be a solenoid, a motor, or another suitable actuator configured to respond to the activation signal and capable of effecting movement (directly or indirectly through the tension lever 26) of the secondary detent 24 to the unlocked position.

Active materials include those compositions that can exhibit a change in stiffness properties, shape and/or dimensions in response to an activation signal, which can be an electrical, magnetic, thermal or a like field depending on the different types of active materials. Preferred active materials include but are not limited to the class of shape memory materials, and combinations thereof. Shape memory materials, also sometimes referred to as smart materials, refer to materials or compositions that have the ability to remember their original shape, which can subsequently be recalled by applying an external stimulus (i.e., an activation signal). As such, deformation of the shape memory material from the original shape can be a temporary condition.

Exemplary shape memory materials include shape memory alloys (SMAs), electroactive polymers (EAPs) such as dielectric elastomers, piezoelectric polymers, magnetic shape memory alloys (MSMA), shape memory ceramics (SMCs), baroplastics, paraffin wax, piezoelectric ceramics, magnetorheological (MR) elastomers, ferromagnetic SMAs, electrorheological (ER) elastomers, and the like, composites of the foregoing shape memory materials with non-shape memory materials, and combinations comprising at least one of the foregoing shape memory materials. For convenience and by way of example, reference herein will be made to shape memory alloys. Electroactive polymers, shape memory ceramics, baroplastics, and the like can be employed in a similar manner as will be appreciated by those skilled in the art in view of this disclosure. For example, with baroplastic materials, a pressure induced mixing of nanophase domains of high and low glass transition temperature (Tg) components affects the shape change. Baroplastics can be processed at relatively low temperatures repeatedly without degradation. SMCs are similar to SMAs but can tolerate much higher operating temperatures than can other shape-memory materials. An example of an SMC is a piezoelectric material.

The ability of shape memory materials to return to their original shape upon the application of external stimuli allows for their use in actuators to apply force resulting in desired motion. Smart material actuators offer the potential for a reduction in actuator size, weight, volume, cost, noise and an increase in robustness in comparison with traditional electromechanical and hydraulic means of actuation.

SMA: Shape memory alloys (SMAs) are alloy compositions with at least two different temperature-dependent phases. The most commonly utilized of these phases are the so-called martensite and austenite phases. In the following discussion, the martensite phase generally refers to the more deformable, lower temperature phase whereas the austenite phase generally refers to the more rigid, higher temperature phase. When the shape memory alloy is in the martensite phase and is heated (e.g., activated by resistive heating), it begins to change (i.e., actuate) into the austenite phase. The temperature at which this phenomenon starts is often referred to as austenite start temperature (As). The temperature at which this phenomenon is complete is often called the austenite finish temperature (Af). When the shape memory alloy is in the austenite phase and is cooled (e.g., by terminating the resistive heating, therefore allowing cooling to ambient temperature), it begins to change into the martensite phase, and the temperature at which this phenomenon starts is often referred to as the martensite start temperature (Ms). The temperature at which austenite finishes transforming to martensite is often called the martensite finish temperature (Mf). The range between As and Af is often referred to as the martensite-to-austenite transformation temperature range while that between Ms and Mf is often called the austenite-to-martensite transformation temperature range. It should be noted that the above-mentioned transition temperatures are functions of the stress experienced by the SMA sample. Generally, these temperatures increase with increasing stress. In view of the foregoing properties, deformation of the shape memory alloy is preferably at or below the austenite start temperature (at or below As). Subsequent heating (activating) above the austenite start temperature causes the deformed shape memory material sample to begin to revert back (i.e., actuate) to its original (nonstressed) permanent shape until completion at the austenite finish temperature. Thus, a suitable activation input or signal for use with shape memory alloys is a thermal activation signal having a magnitude that is sufficient to cause transformations between the martensite and austenite phases.

The temperature at which the shape memory alloy remembers its high temperature form (i.e., its original, nonstressed shape) when heated can be adjusted by slight changes in the composition of the alloy and through thermo-mechanical processing. In nickel-titanium shape memory alloys, for example, it can be changed from above about 100 degrees Celsius to below about −100 degrees Celsius. The shape recovery process can occur over a range of just a few degrees or exhibit a more gradual recovery over a wider temperature range. The start or finish of the transformation can be controlled to within several degrees depending on the desired application and alloy composition. The mechanical properties of the shape memory alloy vary greatly over the temperature range spanning their transformation, typically providing shape memory effect and superelastic effect. For example, in the martensite phase a lower elastic modulus than in the austenite phase is observed. Shape memory alloys in the martensite phase can undergo large deformations by realigning the crystal structure arrangement with the applied stress. As will be described in greater detail below, the material will retain this shape after the stress is removed.

Suitable shape memory alloy materials include, but are not intended to be limited to, nickel-titanium based alloys, indium-titanium based alloys, nickel-aluminum based alloys, nickel-gallium based alloys, copper based alloys (e.g., copper-zinc alloys, copper-aluminum alloys, copper-gold, and copper-tin alloys), gold-cadmium based alloys, silver-cadmium based alloys, indium-cadmium based alloys, manganese-copper based alloys, iron-platinum based alloys, iron-palladium based alloys, and the like. The alloys can be binary, ternary, or any higher order so long as the alloy composition exhibits a shape memory effect, e.g., change in shape, orientation, yield strength, flexural modulus, damping capacity, superelasticity, and/or similar properties. Selection of a suitable shape memory alloy composition depends, in part, on the temperature range of the intended application.

The recovery to the austenite phase at a higher temperature is accompanied by very large (compared to that needed to deform the material) stresses (i.e., resulting actuation forces) which can be as high as the inherent yield strength of the austenite material, sometimes up to three or more times that of the deformed martensite phase. For applications that require a large number of operating cycles, a strain in the range of up to 4% of the deformed length of wire used can be obtained. In experiments performed with FLEXINOL® wires of 0.5 mm diameter, the maximum strain for large cycle number operation on the order of 4% was obtained. This percentage can increase up to 8% for applications with a low number of cycles.

EAPS: The active material may also comprise an electroactive polymer such as conductive polymers, piezoelectric polymeric material and the like. As used herein, the term "piezoelectric" is used to describe a material that mechanically deforms when a voltage potential is applied, or conversely, generates an electrical charge when mechanically deformed Electroactive polymers include those polymeric materials that exhibit piezoelectric, pyroelectric, or electrostrictive properties in response to electrical or mechanical fields. The materials generally employ the use of compliant electrodes that enable polymer films to expand or contract in the in-plane directions in response to applied electric fields or mechanical stresses. An example of an electrostrictive-grafted elastomer is a piezoelectric poly (vinylidene fluoride-trifluoro-ethylene) copolymer. This combination has the ability to produce a varied amount of ferroelectric-electrostrictive molecular composite systems. These may be operated as a piezoelectric sensor or even an electrostrictive actuator.

Materials suitable for use as an electroactive polymer may include any substantially insulating polymer or rubber (or combination thereof) that deforms in response to an electrostatic force or whose deformation results in a change in electric field. Exemplary materials suitable for use as a pre-strained polymer include silicone elastomers, acrylic elastomers, polyurethanes, thermoplastic elastomers, copolymers comprising PVDF, pressure-sensitive adhesives, fluoroelastomers, polymers comprising silicone and acrylic moieties, and the like. Polymers comprising silicone and acrylic moieties may include copolymers comprising silicone and acrylic moieties, polymer blends comprising a silicone elastomer and an acrylic elastomer, for example.

Materials used for electrodes of the present disclosure may vary. Suitable materials used in an electrode may include graphite, carbon black, colloidal suspension, thin metals including silver and gold, silver filled and carbon filled gels and polymers, and ionically or electronically conductive polymers. It is understood that certain electrode materials may work well with particular polymers and may not work as well for others. By way of example, carbon fibrils work well with acrylic elastomer polymers while not as well with silicone polymers.

SMCs/Piezoelectric Materials: The active material may also comprise a piezoelectric material. As used herein, the term "piezoelectric" is used to describe a material that mechanically deforms (changes shape) when a voltage potential is applied, or conversely, generates an electrical charge when mechanically deformed. Preferably, a piezoelectric material is disposed on strips of a flexible metal or ceramic sheet. The strips can be unimorph or bimorph. Preferably, the strips are bimorph, because bimorphs generally exhibit more displacement than unimorphs.

One type of unimorph is a structure composed of a single piezoelectric element externally bonded to a flexible metal foil or strip, which is stimulated by the piezoelectric element when activated with a changing voltage and results in an axial buckling or deflection as it opposes the movement of the piezoelectric element. The actuator movement for a unimorph can be by contraction or expansion. Unimorphs can exhibit a strain of as high as about 10%, but generally can only sustain low loads relative to the overall dimensions of the unimorph structure. In contrast to the unimorph piezoelectric device, a bimorph device includes an intermediate flexible metal foil sandwiched between two piezoelectric elements. Bimorphs exhibit more displacement than unimorphs because under the applied voltage one ceramic element will contract while the other expands. Bimorphs can exhibit strains up to about 20%, but similar to unimorphs, generally cannot sustain high loads relative to the overall dimensions of the unimorph structure.

Suitable piezoelectric materials include inorganic compounds, organic compounds, and metals. With regard to organic materials, all of the polymeric materials with noncentrosymmetric structure and large dipole moment group(s) on the main chain or on the side-chain, or on both chains within the molecules, can be used as candidates for the piezoelectric film. Examples of suitable polymers include, for example, but are not limited to, poly(sodium 4-styrenesulfonate) ("PSS"), poly S-119 (Poly(vinylamine) backbone azo chromophore), and their derivatives; polyfluorocarbines, including polyvinylidene fluoride ("PVDF"), its co-polymer vinylidene fluoride ("VDF"), trifluoroethylene (TrFE), and their derivatives; polychlorocarbons, including poly(vinylchloride) ("PVC"), polyvinylidene chloride ("PVC2"), and their derivatives; polyacrylonitriles ("PAN"), and their derivatives; polycarboxylic acids, including poly (methacrylic acid ("PMA"), and their derivatives; polyureas, and their derivatives; polyurethanes ("PUE"), and their derivatives; bio-polymer molecules such as poly-L-lactic acids and their derivatives, and membrane proteins, as well as phosphate bio-molecules; polyanilines and their derivatives, and all of the derivatives of tetramines; polyimides, including Kapton molecules and polyetherimide ("PEI"), and their derivatives; all of the membrane polymers; poly (N-vinyl pyrrolidone) ("PVP") homopolymer, and its derivatives, and random PVP-co-vinyl acetate ("PVAc") copolymers; and all of the aromatic polymers with dipole moment groups in the main-chain or side-chains, or in both the main-chain and the side-chains, and mixtures thereof.

Further, piezoelectric materials can include Pt, Pd, Ni, T, Cr, Fe, Ag, Au, Cu, and metal alloys and mixtures thereof. These piezoelectric materials can also include, for example, metal oxide such as $SiO_2$, $Al_2O_3$, $ZrO_2$, $TiO_2$, $SrTiO_3$, $PbTiO_3$, $BaTiO_3$, $FeO_3$, $Fe_3O_4$, ZnO, and mixtures thereof and Group VIA and IIB compounds, such as CdSe, CdS, GaAs, $AgCaSe_2$, ZnSe, GaP, InP, ZnS and mixtures thereof.

MR Elastomers: Suitable active materials also comprise magnetorheological (MR) compositions, such as MR elastomers, a class of smart materials whose rheological properties can rapidly change upon application of a magnetic field. MR elastomers are suspensions of micrometer-sized, magnetically polarizable particles in a thermoset elastic polymer or rubber. The stiffness of the elastomer structure is accomplished by changing the shear and compression/tension moduli by varying the strength of the applied magnetic field. The MR elastomers typically develop their structure when exposed to a magnetic field in as little as a few milliseconds. Discontinuing the exposure of the MR elastomers to the magnetic field reverses the process and the elastomer returns to its lower modulus state. Suitable MR elastomer materials include, but are not intended to be limited to, an elastic polymer matrix comprising a suspension of ferromagnetic or paramagnetic particles, wherein the particles are described above. Suitable polymer matrices include, but are not limited to, poly-alpha-olefins, natural rubber, silicone, polybutadiene, polyethylene, polyisoprene, and the like.

MSMA: MSMAs are alloys, often composed of Ni—Mn—Ga, that change shape due to strain induced by a magnetic field. MSMAs have internal variants with different magnetic and crystallographic orientations. In a magnetic field, the proportions of these variants change, resulting in an overall shape change of the material. An MSMA actuator generally requires that the MSMA material be placed between coils of an electromagnet. Electric current running through the coil induces a magnetic field through the MSMA material, causing a change in shape.

In the latch assembly 10 shown in FIGS. 1-3, the actuator 30 may be an active material, such as (without limitation) an SMA wire. Other geometric forms of SMA may be used, such as, without limitation: a cable, multiple wires in parallel, a strip, a rod, or another shape recognized by those having ordinary skill in the art as capable of moving the secondary detent 24 from the locked to the unlocked position. Other types of actuators 30 may be used with the latch assembly 10, and the specific types of actuators identified herein are not intended to be limiting.

The activation signal for the actuator 30 may occur via an electrical current passing through the actuator 30, if it the SMA wire is used. Upon application of the activation signal, the actuator 30 contracts, causing the tension lever 26 to rotate and the secondary detent 24 to move from the locked to the unlocked position (both clockwise, as viewed in FIGS. 1-3). This movement of the secondary detent 24 allows movement of the primary detent 16 and forkbolt 12, which are then able to move into the open position and released position, respectively. A solenoid-based actuator 30 may be used to impart the same action.

Due to the utilization of both the primary detent 16 and the secondary detent 24, and their relational geometries, the movement required to disengage the secondary detent 24 from the primary detent 16 is relatively small compared to the movement required to disengage the primary detent 16 from the forkbolt 12 to release the latch. Similarly, the force required to disengage the secondary detent 24 from the primary detent 16 is relatively small compared to the force required to disengage the primary detent 16 from the forkbolt 12. Furthermore, the primary detent spring 18 applies a biased torque to move the primary detent 16 to the unlatched position which further reduces the forces that the secondary detent 24 has to counteract. Consequently the force applied by the actuator 30 on the tension lever 26 is greatly reduced. This reduction in travel and force enables the use of an SMA wire as the actuator 30 since it is now within the range of the SMA technology.

In the latch assembly 10 shown in FIGS. 1-3, the secondary detent 24 is rotated from the locked to the unlocked position by the tension lever 26. This rotation, combined with the use of different radii, as opposed to translational movement, further increases the mechanical advantage of the latch assembly 10 and reduces the total distance/contraction of the actuator 30.

The reduction in work required by the actuator 30—through both the reduced force needs and distance requirements—allows the use of smaller actuators. For example, the SMA wire or solenoid actuator can be reduced in both cross-section and in length because of the two-lever latch assembly 10. The reduced length and cross-section may yield improved weight, improved latch size, and improved assembly characteristics.

Furthermore, the independent return motion of the tension lever 26 relative to the secondary detent 24 allows the actuator 30 to be reset to its locked position even though the secondary detent 24 is still in the unlocked position. For example, if the actuator 30 is a solenoid, the coil of the solenoid may be de-energized to reduce power consumption. If the actuator 30 is the SMA wire, the current supplied to the wire may be removed or cut to reduce power consumption, which will also allow the return spring 29 to stretch the SMA wire back to its full length.

Those having ordinary skill in the art will recognize that the path and alignment of the actuator 30 shown in FIGS. 1-3 is illustrative only, and the actuator 30 may be oriented or routed differently to better effect movement of the secondary detent 24. The illustrative location of actuator 30 represents one location and orientation capable of causing movement of the tension lever 26 and the secondary detent 24 when the activation signal is provided to the actuator 30.

The activation signal is selectively produced by a control system 34 which is operatively connected to a power system (not shown) of the vehicle and operatively connected to the actuator 30. Where the activation signal is an electric current, the control system 34 selectively subjects actuator 30 to a voltage differential, causing electric current to flow through the actuator 30. Control system 34 may operate with power or energy derived from the vehicle power system, and therefore may not operate when the power system is not operating.

The actuator 30 may complete its own circuit by running or looping from the actuator base 32 to tension lever 26 and back, or the tension lever 26 may be configured to complete the circuit. In the latch assembly 10 shown in FIGS. 1-3, the current causes a temperature increase in the SMA wire, which triggers a phase change in the SMA and causes contraction of the actuator 30.

The control system 34 may include a cut-off switch 36, which is configured to come into contact with the primary detent 16 whenever the primary detent 16 is in the open position or with the secondary detent 24 whenever the secondary detent 24 is in the unlocked position. The cut-off switch 36 may therefore be configured to cut power to the actuator 30 (or to turn off the activation signal) when the primary detent 16 is in the open position or when the secondary detent 24 is in the unlocked position. This will allow the actuator 30 to return to its non-energized position and may protect against overheating the actuator 30. Alternatively, the control system 34 may have another sensor—such as an optical or position sensor—for determining when the primary detent 16 is in the open position and cutting off the activation signal.

As shown in FIG. 2, the actuator 30 has moved the tension lever 26 to engage the secondary detent 24 and to rotate the secondary detent 24 into the unlocked position. However, the forkbolt 12 has not substantially moved or rotated. Therefore, the primary detent 16 rotates under the bias of the primary detent spring 18, but only to close the cam tooth clearance 25. At this position, the primary detent 16 allows further rotation of the forkbolt 12, but also does not allow the secondary detent 24 to move back to the locked position and re-latch the latch assembly 10. The slight movement of the primary detent 16 out of the closed position may be sufficient to trigger the cut-off switch 36 and disengage the actuator 30.

As shown in FIG. 3, once the actuator 30 is disengaged, the return spring 29 will be able to return the tension lever 26 to the starting position. The secondary detent 24 will not return to the locked position until the primary detent 16 returns to the closed position. Therefore, after the actuator 30 is disengaged, regardless of whether the forkbolt 12 has moved into the released position, the tension lever 26 returns to the starting position, resetting the actuator 30 for subsequent operations.

The primary detent 16 may subsequently be returned to the closed position (as shown in FIG. 1) by closing the vehicle closure to force the striker bar 15 back into the forkbolt 12. As the vehicle closure is closed, the striker bar 15 will rotate the second cam tooth 23 into the first cam tooth 22 of the primary detent 16, overcoming the bias force of the primary detent spring 28 and causing the primary detent 16 to return to the closed position. The forkbolt 12 may be configured to over-rotate past the position shown in FIG. 1 to ensure that the cam tooth clearance 25 temporarily closes and the primary detent 16 rotates all the way back to the closed position.

The latch assembly 10 may further include an auxiliary actuation mechanism 38. For example, and without limitation, the latch assembly 10 may have a manual actuation component configured to rotate the secondary detent 24 from the locked to the unlocked position in order to open the forkbolt 12 and allow the closure to be opened if there is too little power to actuate the actuator 30. The tension lever 26 may also be rotated to manually release the forkbolt 12.

Alternatively, the auxiliary actuation mechanism 38 may be an auxiliary power source that is selectively connected to the control system 34 or the actuator 30, when necessary, to cause the secondary detent 24 to unlock or to send the activation signal to the actuator 30. The auxiliary actuation mechanism 38 is characterized by a lack of reliance on the power system of the vehicle. Furthermore, because the primary detent spring 18 is configured to bias the primary detent 16 toward the open position, the auxiliary actuation mechanism 38 need only free the primary detent 16 from the restraint of the secondary detent 24.

Figure 4:
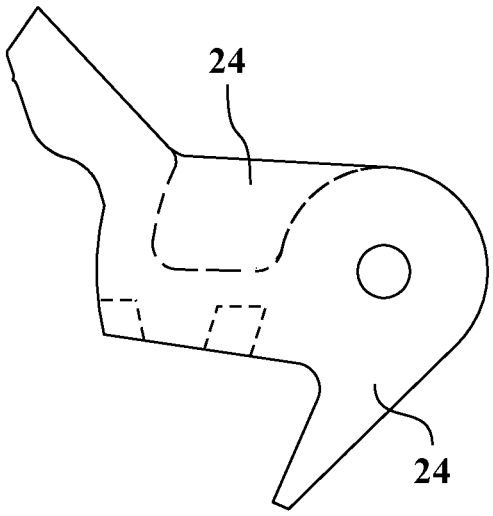
FIG. 4 is a schematic plan view of a secondary detent shown in FIGS. 1-3.
Figure 5:
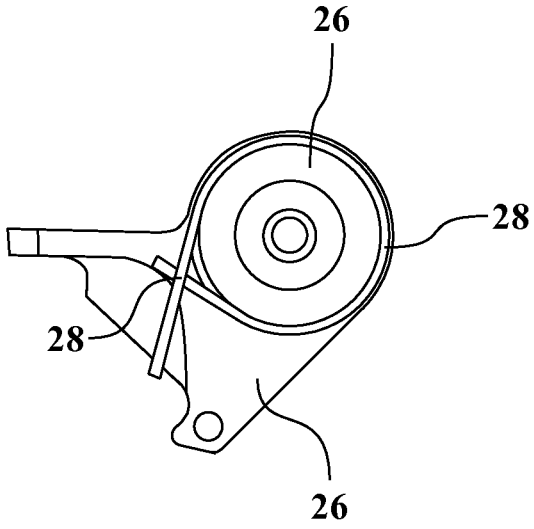
FIG. 5 is a schematic plan view of a tension lever and a tension spring shown in FIGS. 1-3.

Referring now to FIG. 4 and FIG. 5, and with continued reference to FIGS. 1-3, there are shown more detailed views of the secondary detent 24 and the tension lever 26. FIG. 4 shows a schematic side view of the secondary detent 24 in substantially the same position as shown in FIG. 1. FIG. 5 shows a schematic side view of the tension lever 26 in substantially the same position as shown in FIG. 1. FIG. 5 also shows the tension spring 28, which is configured to cause the secondary detent 24 and the tension lever 26 to rotate in opposing directions and to bias the secondary detent 24 toward the locked position.

While the present invention is described in detail with respect to automotive applications, those skilled in the art will recognize the broader applicability of the invention. Those having ordinary skill in the art will recognize that terms such as "above," "below," "upward," "downward," et cetera, are used descriptively of the figures, and do not represent limitations on the scope of the invention, as defined by the appended claims.

While the best modes and other modes for carrying out the claimed invention have been described in detail, those familiar with the art to which this invention relates will recognize various alternative designs and embodiments for practicing the invention within the scope of the appended claims.

The invention claimed is:

1. A latch assembly for a vehicle having a closure, comprising:

a forkbolt movable between a released position and a restrained position, wherein the released position allows opening of the closure and the restrained position prevents opening of the closure;

a forkbolt spring operatively attached to the forkbolt and configured to bias the forkbolt toward the released position;

a primary detent mounted with respect to the forkbolt and movable between an open position and a closed position, wherein the open position of the primary detent allows the forkbolt to move into the released position and the closed position of the primary detent does not allow the forkbolt to move into the released position;

a primary detent spring operatively attached to the primary detent, wherein the primary detent spring is configured to bias the primary detent toward the open position;

a secondary detent mounted with respect to the primary detent and movable between an unlocked position and a locked position, wherein the unlocked position of the secondary detent allows the primary detent to move into the open position and the locked position of the secondary detent will not allow the primary detent to move into the open position;

a tension spring operatively attached to the secondary detent and configured to bias the secondary detent toward the locked position; and an actuator configured to selectively move the secondary detent from the locked position to the unlocked position in the presence of an activation signal.

2. The latch assembly of claim 1, wherein the primary detent includes a first bite tooth and a first cam tooth, wherein the forkbolt includes a second bite tooth and a second cam tooth, wherein the first bite tooth and the second bite tooth are in contact when the forkbolt is in the restrained position and the primary detent is in the closed position, and wherein the first cam tooth and the second cam tooth are separated by a cam tooth clearance when the forkbolt is in the restrained position and the primary detent is in the closed position.

3. The latch assembly of claim 2, wherein placing the primary detent into the open position while the forkbolt is in the restrained position closes the cam tooth clearance, such that the first cam tooth and the second cam tooth are placed into contact.

4. The latch assembly of claim 3, further comprising:

a tension lever operatively connected to the secondary detent and the actuator, wherein the tension lever is configured to move the secondary detent from the locked position to the unlocked position in the presence of the activation signal to the actuator.

5. The latch assembly of claim 4, wherein the tension lever is configured not to move the secondary detent from the unlocked position to the locked position in the absence of the activation signal to the actuator, such that only the tension spring moves the secondary detent from the unlocked position to the locked position.

6. The latch assembly of claim 5, wherein the tension spring is configured to bias the tension lever and the secondary detent to rotate is opposing directions.

7. The latch assembly of claim 6, further comprising:

a cut-off switch, wherein the cut-off switch is configured to remove the activation signal in response to the secondary detent being in the unlocked position.

8. The latch assembly of claim 7, wherein the actuator is an active material based actuator.

9. The latch assembly of claim 8, wherein the activation signal is an electrical current passing through the active material based actuator.

10. The latch assembly of claim 9, wherein the active material based actuator is a shape memory alloy wire.

11. The latch assembly of claim 7, wherein the actuator is a solenoid.

12. The latch assembly of claim 5, further comprising an auxiliary activation mechanism configured to selectively move the secondary detent from the locked position to the unlocked position, wherein the auxiliary activation mechanism is characterized by a lack of reliance on a power system of the vehicle.

13. A latch assembly for a vehicle having a closure, comprising:

a forkbolt movable between a released position and a restrained position, wherein the released position allows opening of the closure and the restrained position prevents opening of the closure;

a forkbolt spring operatively attached to the forkbolt and configured to bias the forkbolt toward the released position;

a primary detent mounted with respect to the forkbolt and movable between an open position and a closed position, wherein the open position of the primary detent allows the forkbolt to move into the released position and the closed position of the primary detent does not allow the forkbolt to move into the released position;

a secondary detent mounted with respect to the primary detent and movable between an unlocked position and a locked position, wherein the unlocked position of the secondary detent allows the primary detent to move into the open position and the locked position of the secondary detent will not allow the primary detent to move into the open position;

a tension spring operatively attached to the secondary detent and configured to bias the secondary detent toward the locked position;

an actuator configured to selectively move the secondary detent from the locked position to the unlocked position in the presence of an activation signal;

a tension lever operatively connected to the secondary detent and the actuator, wherein the tension lever is configured to move the secondary detent from the locked position to the unlocked position in the presence of the activation signal to the actuator; and an auxiliary activation mechanism configured to selectively move the secondary detent from the locked position to the unlocked position, wherein the auxiliary activation mechanism is characterized by a lack of reliance on a power system of the vehicle.

14. The latch assembly of claim 13, wherein the primary detent includes a first bite tooth and a first cam tooth, wherein the forkbolt includes a second bite tooth and a second cam tooth, wherein the first bite tooth and the second bit tooth are in contact when the forkbolt is in the restrained position and the primary detent is in the closed position, and wherein the first cam tooth and the second cam tooth are separated by a cam tooth clearance when the forkbolt is in the restrained position and the primary detent is in the closed position.

15. The latch assembly of claim 14, wherein placing the primary detent into the open position while the forkbolt is in the restrained position closes the cam tooth clearance, such that the first cam tooth and the second cam tooth are placed into contact.

16. The latch assembly of claim 15, further comprising:

a primary detent spring operatively attached to the primary detent, wherein the primary detent spring is configured to bias the primary detent toward the open position.

* * * * *